United States Patent [19]

Russello

[11] 4,378,584

[45] Mar. 29, 1983

[54] HANGING LIGHT FIXTURE MOUNTING ARRANGEMENT

[75] Inventor: Thomas Russello, Elizabeth, N.J.

[73] Assignee: Keene Corporation, Union, N.J.

[21] Appl. No.: 260,048

[22] Filed: May 4, 1981

[51] Int. Cl.[3] ..... F21V 21/00

[52] U.S. Cl. ..... 362/396; 362/226; 362/368

[58] Field of Search ..... 362/226, 368, 396

[56] References Cited

U.S. PATENT DOCUMENTS 4,199,803 4/1980 Hunt ..... 362/396

4,303,968 12/1981 Goralnik ..... 362/396

*Primary Examiner*—Stephen J. Lechert, Jr.

*Attorney, Agent, or Firm*—Kane, Dalsimer, Kane, Sullivan and Kurucz

[57] ABSTRACT

A mounting arrangement for a hanging light fixture is provided wherein the fixture is connected to a power housing through an electric cord and hook arrangement. A plug on the cord along with surfaces of the fixture and power housing prevent the hooks from being disengaged prior to the electric cord being disconnected from a power receptacle.

5 Claims, 2 Drawing Figures

HANGING LIGHT FIXTURE MOUNTING ARRANGEMENT

BACKGROUND OF THE INVENTION

The present invention relates to light fixtures and in particular to an improved mounting arrangement for a light fixture in which the electrical connections and power connections are separately made.

Hanging light fixtures are usually supported by a conduit through which the power leads extend. In certain types of light fixtures, however, the fixture power connections are made through a cord and plug which engage a receptacle. The fixture is then supported mechanically by an independent hook arrangement. To insure proper support for the fixture, the support hooks must be engaged before the cord is plugged into the receptacle and conversely the plug should be removed before the hooks are disengaged. The situation to be avoided is one in which the fixture is supended only by the plug engaging the receptacle.

A potential problem arises in that an inexperienced maintenance person or technician might disconnect the support hooks during installation or maintenance believing that the plug-receptacle connection is sufficient to support the fixture. Since this could lead to the fixture falling and causing injury and damage, it is a situation which should be avoided.

Another potential problem which sometimes occurs is that the fixture is permitted to drop on the support hook. This causes stress on the receptacle housing which can result in the receptacle cracking particularly where the receptacle is cast. Also if the fixture is hit from the sides or the bottom, the two support hooks allow the fixture to swing freely. This in turn prevents any stress build up on the casting.

In view of the above, it is a principal object of the present invention to provide an improved installation arrangement for a hanging fixture of the type described which insures against the fixture being suspended only by the plug-receptacle connection.

A further object is to provide such an arrangement which is readily adaptable to conventional light fixtures.

A further object is to provide such an arrangement in which the possibility of the receptacle cracking is minimized even if the fixture is dropped into place or hit from the sides or bottom.

A further object is to provide such an arrangement which is aesthetically pleasing, permits convenient installation and which may be competitively priced.

Other benefits stemming from the present invention will be apparent from the following description.

SUMMARY OF THE INVENTION

The above and other beneficial objects and advantages are attained in accordance with the present invention by providing a hanging fixture mounting arrangement for a fixture in which the electrical connections are made through a plug and receptacle and a pair of hooks to support the fixture. A power housing having a power cord receptacle and a first hook member is provided suspended from the ceiling to which the fixture is to be installed. The fixture housing has a second hook member and power cord. The power cord terminates in an enlarged plug, surfaces of which cooperate with surfaces of the power housing and fixture housing in preventing the hook members from being disengaged when the plug is positioned in the receptacle.

The power housing botton surface contains the receptacle and also has a slot therein through which the base of a U-shaped hook member extends. The fixture housing hook comprises an inverted U-shaped member one leg of which is connected to the housing top surface and the other end of which is free. The portion of the bottom surface of the power housing containing the slotted opening is inclined with respect to the portion of the bottom surface containing the receptacle so that the free leg of the inverted U must be directed toward the receptacle when the hook members are engaged. The length of the legs of the inverted U is greater than the distance between the first hook member and enlarged plug when the plug is in the receptacle so that the plug prevents the hook members from being disengaged when the plug is in the receptacle and the hook members are engaged.

A unique feature of the present invention is that the power housing hook is vertically aligned with the feed conduit and permitted to float freely within the power housing. In this way, even if the fixture is dropped into position or hit from the sides or bottom, the weight of the fixture is transmitted directly to the support conduit thereby minimizing the load transmitted to the power housing which could cause cracking.

DETAILED DESCRIPTION OF THE PREFERRED EMBODIMENT

Figure 1:
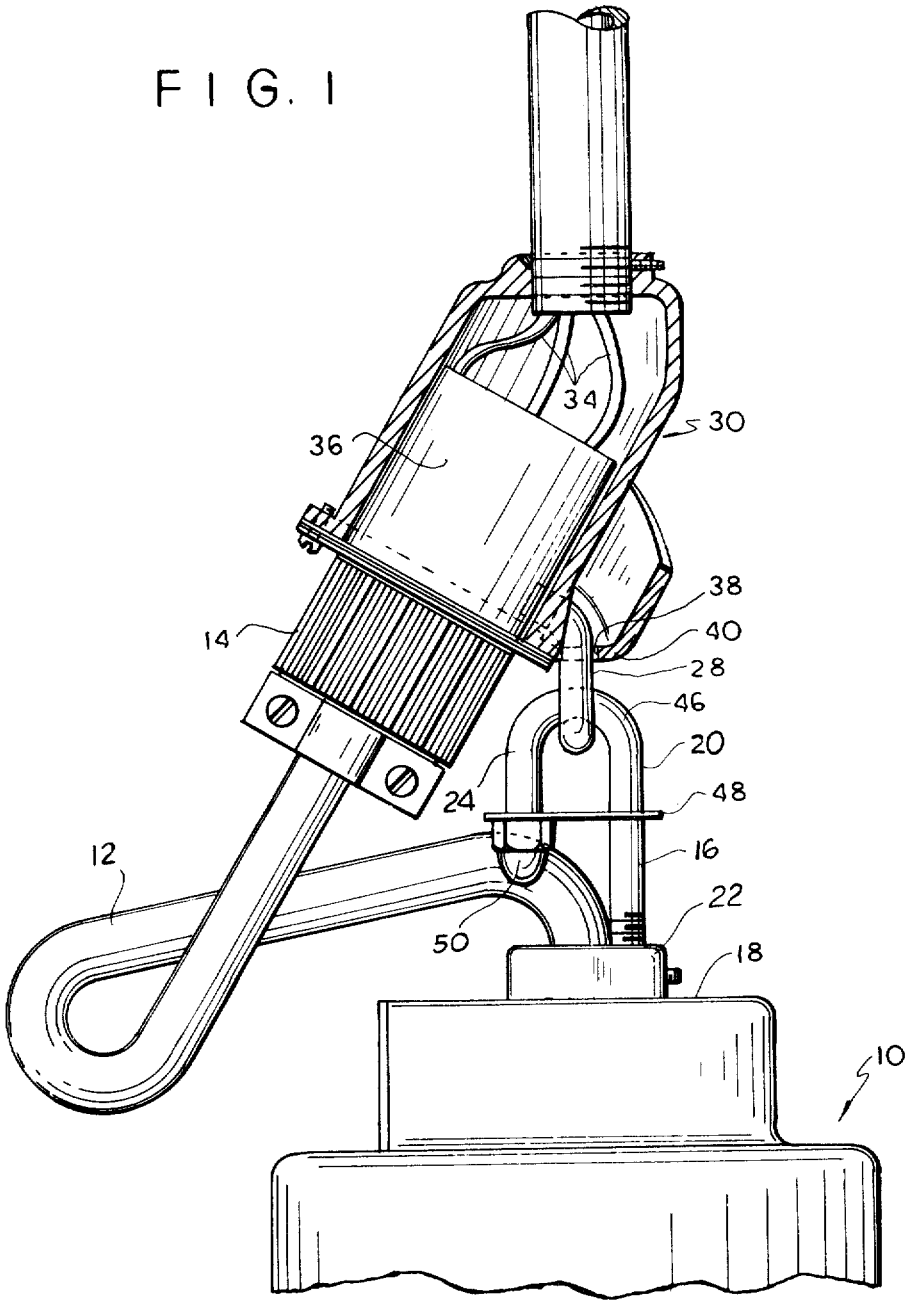
FIG. 1 is a side elevational sectional view of a hanging light fixture mounting arrangement in accordance with the present invention; and, FIG. 2 is an exploded perspective view of the principal components of the mounting arrangement of the present invention.

Reference is now made to the drawings wherein the mounting arrangement of the present invention is depicted. In accordance with the present invention, a light fixture 10 (the details of which are not shown), is provided with a flexible power cord 12 which terminates in an enlarged plug 14. A hook 16 in the form of an inverted "U" extends from the top surface 18 of the fixture. One leg 20 of hook 16 is secured by set screw thru hub 22 to the fixture 18. The other leg 24 of hook 16 terminates in a threaded free end 26. The power cord 12 is connected to the lamp socket of fixture 10 in the usual manner.

Hook 16 is designed to engage a hook element 28 of power housing 30. The power housing 30 is secured to a length of conduit 32 through which the leads 34 from the installation facility power supply are brought to a receptacle 36. Receptacle 36 is mounted to extend through the bottom surface 38 of the power housing.

Figure 2:
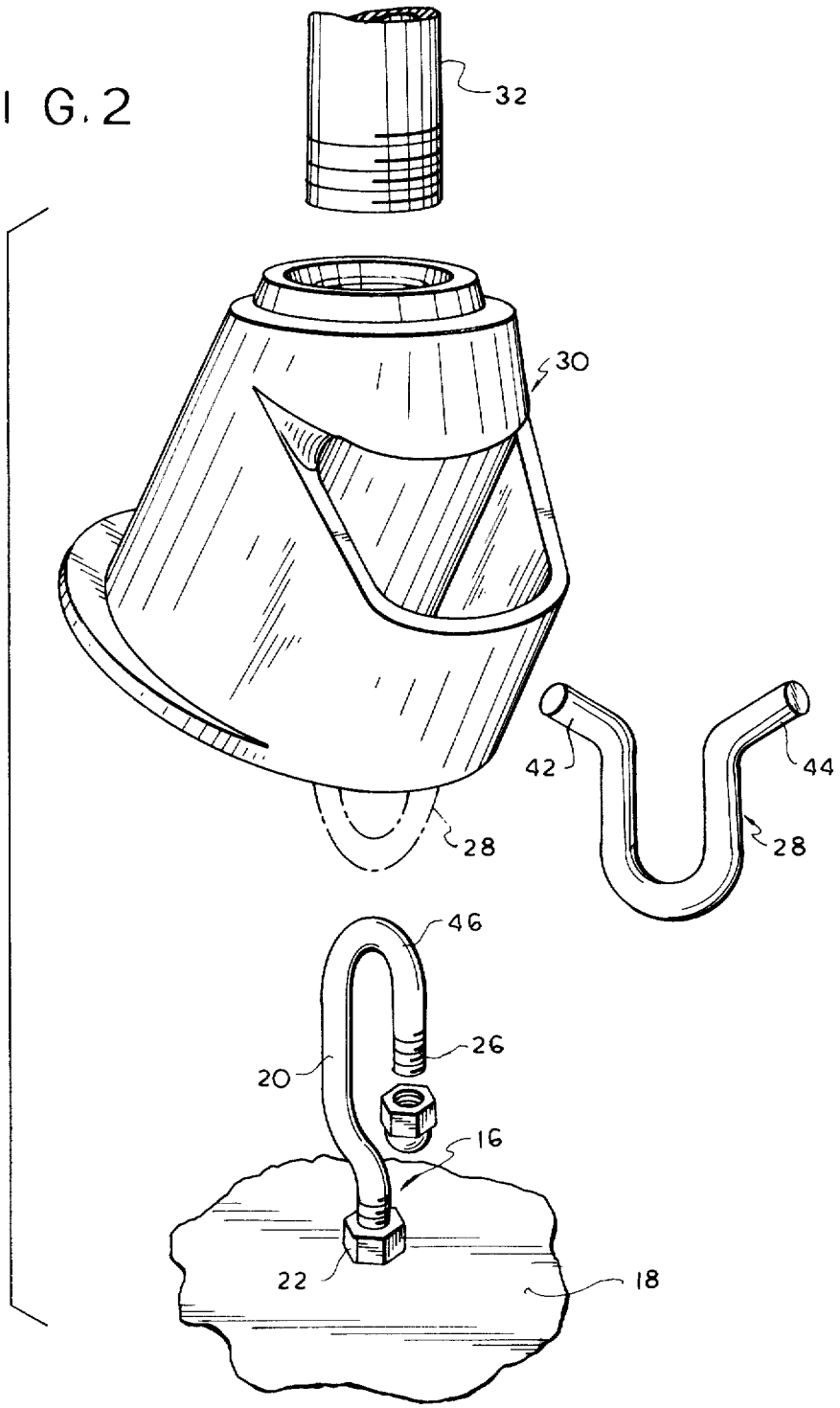

Hook member 28 comprises a "U" shaped member which fits in a slotted opening 38 in a portion 40 of the power housing bottom surface as shown in FIG. 2. Hook member 28 is provided with flanges 42, 44 extending outwardly from its free ends. The flanges rest on top of the power housing base portion 40 adjacent slot 38 and prevent the hook member 28 from falling through the slotted opening. As a result, the lower portion of member 28 along with portions of the power housing bottom surface define an eye for hook 16. Hook member 28 fits freely in the slotted opening held in place only by flanges 42, 44 as well as the weight of fixture 10 when the fixture is in position.

As may be noted in FIG. 1, the portion 40 of the power housing base containing the slotted opening for hook member 28 is inclined with respect to the portion of the base containing the openings for receptacle 36. As a result, when plug 14 is in position, it extends at an angle with respect to the plane of portion 40. The length of the legs 20, 24 of the inverted "U" shaped member 16 is such that the plug 44 of cord 12 interfers with top surface 18 preventing removal of hook member 16 from member 28 even when the guard 48 and cap nut 50 are removed. That is, the plug 14 prevents the free end 26 of hook 16 from clearing member 28. Thus, plug 14 must be removed from receptacle 36 before hook member 16 can be disengaged from hook member 28.

By inclining surface 40 with respect to the receptacle face, the free end 26 of hook member 16 must project toward the plug 14 during installation.

It should be noted that hook member 28 is vertically aligned with conduit 32 which ultimately supports the entire fixture weight. It should also be noted that hook member 28 floats freely within the slotted opening 38. In this manner the fixture weight is transmitted directly to the conduit with minimum transmission through the power housing. As a result, even if the fixture load is dropped on hook 28 suddenly, the chances of the housing cracking are minimized. This is particularly important where the power housing is cast (as is usually the case) and thus in a stressed condition.

Thus, in accordance with the above, the aforementioned objects are effectively attained.

I claim:

1. A fixture mounting arrangement for a hanging fixture to be suspended from a length of conduit comprising:

a power housing secured to said conduit and including a power cord receptacle and a first hook member; said first hook member being vertically aligned with said conduit;

a fixture housing including a power cord extending therefrom, an enlarged plug at a free end of said cord; and a second hook member complementary to said first hook member;

said power housing, enlarged plug and fixture housing each containing surfaces thereon adapted to interfere with and prevent the disengagement of said hook members when said plug is in said receptacle and said hook members are engaged whereby said plug must be removed from said receptacle before said hook members may be disengaged.

2. The invention in accordance with claim 1 wherein said first hook member floats freely within said power housing.

3. The invention in accordance with claim 2 wherein said power housing includes a bottom surface having an elongated slotted opening in said surface and said first hook member is U-shaped having outwardly extending flanges from the free ends of said U, said flanges rest on the top of said bottom surface with said U extending through said slot below said bottom surface.

4. The invention in accordance with claim 3 wherein said receptacle is in said bottom surface and said second hook member comprises an inverted U, the length of the legs of said inverted U being greater than the distance between the first hook member and enlarged plug when said plug is in said receptacle whereby said plug prevents said hook members from being disengaged when said plug is in said receptacle.

5. The invention in accordance with claim 4 wherein one leg of said inverted U is secured to said fixture housing and the other leg of said inverted U is free; and the portion of the bottom surface of said housing containing said slotted opening is inclined with respect to the portion of said bottom surface containing said receptacle whereby said inverted U free leg must be facing said receptacle when said hook members are engaged.

* * * * *